US009834418B2

(12) United States Patent
Gerard

(10) Patent No.: US 9,834,418 B2
(45) Date of Patent: Dec. 5, 2017

(54) BOAT DEPLOYMENT ASSEMBLY AND METHOD

(71) Applicant: Par Systems, Inc., Shoreview, MN (US)

(72) Inventor: Michael Gerard, Iron Mountain, MI (US)

(73) Assignee: PAR SYSTEMS, INC., Shoreview, MN (US)

( * ) Notice: Subject to any disclaimer, the term of this patent is extended or adjusted under 35 U.S.C. 154(b) by 80 days.

(21) Appl. No.: 14/032,862

(22) Filed: Sep. 20, 2013

(65) Prior Publication Data

US 2014/0086719 A1 Mar. 27, 2014

Related U.S. Application Data

(60) Provisional application No. 61/703,964, filed on Sep. 21, 2012.

(51) Int. Cl.

| | |
|---|---|
| ***B66D 1/26*** | (2006.01) |
| ***B63C 3/06*** | (2006.01) |
| ***B63B 23/48*** | (2006.01) |
| ***B63B 23/60*** | (2006.01) |

(52) U.S. Cl.

CPC ..... *B66D 1/26* (2013.01); *B63B 23/48* (2013.01); *B63B 23/60* (2013.01); *B63C 3/06* (2013.01)

(58) Field of Classification Search

USPC ..... 254/278; 114/368

See application file for complete search history.

(56) References Cited

U.S. PATENT DOCUMENTS

| | | | |
|---|---|---|---|
| 300,344 | A | 6/1884 | Chamblin et al. |
| 655,367 | A | 8/1900 | Morgan |
| 1,419,129 | A | 6/1922 | Fitch |
| 2,004,133 | A | 6/1935 | Romano |

(Continued)

FOREIGN PATENT DOCUMENTS

| | | |
|---|---|---|
| DE | 2115587 | 10/1972 |
| DE | 2115587 A1 | 10/1972 |

(Continued)

OTHER PUBLICATIONS

International Search Report and Written Opinion of corresponding foreign application PCT/US2013/060941, filed Sep. 20, 2013.

(Continued)

*Primary Examiner* — Emmanuel M Marcelo
(74) *Attorney, Agent, or Firm* — Steven M. Koehler; Westman, Champlin & Koehler, P.A.

(57) ABSTRACT

A hoist system and a method for lifting and lowering an object such as a boat include a support structure, a support member supported by the support structure and a hoisting assembly. The hoisting assembly includes an attachment assembly and a set of at least three flexible members operably coupled to the support member and the attachment assembly to retract and extend the attachment assembly vertically relative to a reference axis. The hoisting assembly is supported by the support structure and configured with the support member so as to space apart the flexible members from each other, and wherein each flexible member defines an oblique angle with the reference axis parallel to the vertical reference axis.

13 Claims, 3 Drawing Sheets

(56) References Cited

U.S. PATENT DOCUMENTS

| | | | | | |
|---|---|---|---|---|---|
| 2,164,128 | A | * | 6/1939 | Medenwald | B66C 13/06 182/36 |
| 2,720,327 | A | | 10/1955 | Bain | |
| 2,869,734 | A | | 1/1959 | Ernestus | |
| 3,043,444 | A | | 7/1962 | Melton | |
| 3,045,839 | A | * | 7/1962 | Hibberd | B63B 9/00 114/44 |
| 3,051,321 | A | | 8/1962 | Ramsden | |
| 3,104,016 | A | | 9/1963 | Robert | |
| 3,107,791 | A | | 10/1963 | Bayard | |
| 3,247,974 | A | | 4/1966 | Dechantsreiter | |
| 3,276,602 | A | | 10/1966 | Vogeley | |
| 3,476,263 | A | | 11/1969 | Toshiro | |
| 3,536,351 | A | * | 10/1970 | Zweifel | B66C 1/102 212/323 |
| 3,567,040 | A | | 3/1971 | Thomson | |
| 3,591,022 | A | * | 7/1971 | Polyakov | B66C 13/02 212/309 |
| 3,671,069 | A | | 6/1972 | Frank | |
| 3,675,258 | A | | 7/1972 | Osmundson | |
| 3,743,107 | A | | 7/1973 | Verschoof | |
| 3,768,664 | A | | 10/1973 | Bauer | |
| 3,837,503 | A | * | 9/1974 | Komatsu | B66C 13/00 212/274 |
| 3,842,986 | A | | 10/1974 | Hupkes | |
| 3,874,513 | A | | 4/1975 | Wilson | |
| 3,874,514 | A | | 4/1975 | Wilson | |
| 3,874,516 | A | * | 4/1975 | Watanabe | B66C 13/06 212/274 |
| 3,887,080 | A | | 6/1975 | Wilson | |
| 3,899,083 | A | | 8/1975 | Hinrich | |
| 3,971,478 | A | | 7/1976 | Vasile | |
| 4,057,942 | A | | 11/1977 | Kranefeld | |
| 4,076,127 | A | | 2/1978 | Leonard | |
| 4,133,514 | A | | 1/1979 | Anderson | |
| 4,142,710 | A | | 3/1979 | Okuda | |
| 4,271,553 | A | | 6/1981 | Korsvik | |
| 4,360,112 | A | | 11/1982 | Brewer | |
| 4,406,244 | A | | 9/1983 | Buchan | |
| 4,687,110 | A | | 8/1987 | Partanen | |
| 4,761,112 | A | | 8/1988 | Hammon | |
| 4,883,184 | A | | 11/1989 | Albus | |
| 4,949,855 | A | | 8/1990 | Foit | |
| 4,953,721 | A | | 9/1990 | Foit | |
| 5,074,528 | A | * | 12/1991 | Long, Jr. | B66D 1/54 254/285 |
| 5,150,799 | A | * | 9/1992 | Long, Jr. | B66C 19/00 212/274 |
| 5,257,891 | A | * | 11/1993 | Baumann et al. | 414/460 |
| 5,261,347 | A | * | 11/1993 | Mansfield | B63C 3/06 114/268 |
| 5,489,033 | A | | 2/1996 | Luebke | |
| 5,507,596 | A | | 4/1996 | Bostelman | |
| 5,520,135 | A | | 5/1996 | Rolland | |
| 5,585,707 | A | | 12/1996 | Thompson | |
| 5,628,416 | A | | 5/1997 | Frommelt | |
| 5,765,703 | A | * | 6/1998 | Shiwaku | B66C 13/08 212/274 |
| 5,769,250 | A | * | 6/1998 | Jussila | B66C 13/08 212/274 |
| 5,819,962 | A | | 10/1998 | Okubo | |
| 6,023,862 | A | | 2/2000 | Sirjola | |
| 6,126,023 | A | | 10/2000 | Durrant-Whyte | |
| 6,182,843 | B1 | | 2/2001 | Tax | |
| 6,216,895 | B1 | | 4/2001 | Erdmann | |
| 6,343,702 | B1 | | 2/2002 | Masumoto | |
| 6,374,147 | B1 | | 4/2002 | Rockwood | |
| 6,382,437 | B1 | * | 5/2002 | Okada | B66C 13/06 212/274 |
| 6,439,407 | B1 | | 8/2002 | Jacoff | |
| 6,474,486 | B1 | | 11/2002 | Baraniak | |
| 6,494,155 | B2 | * | 12/2002 | Gibson | B63C 3/06 114/44 |
| 6,566,834 | B1 | | 5/2003 | Albus | |
| 6,644,486 | B2 | | 11/2003 | Jacoff | |
| 6,648,102 | B2 | | 11/2003 | Bostelman | |
| 6,826,452 | B1 | | 11/2004 | Holland | |
| 6,827,334 | B2 | | 12/2004 | Volle | |
| 7,284,744 | B1 | | 10/2007 | Lerchenmueller | |
| 7,287,740 | B2 | | 10/2007 | Reyes | |
| 7,392,914 | B2 | | 7/2008 | Sorsa | |
| 7,575,214 | B2 | | 8/2009 | Badalament | |
| 7,896,324 | B2 | | 3/2011 | Okazaki | |
| 7,918,354 | B2 | * | 4/2011 | Shan | B66C 1/104 212/274 |
| 8,195,368 | B1 | | 6/2012 | Leban | |
| 8,402,898 | B2 | | 3/2013 | Rodnunsky | |
| 8,646,630 | B2 | | 2/2014 | Franzen | |
| 2002/0144967 | A1 | | 10/2002 | Jacoff | |
| 2004/0146388 | A1 | | 7/2004 | Khajepour | |
| 2005/0024004 | A1 | | 2/2005 | Rodnunsky | |
| 2005/0024005 | A1 | | 2/2005 | Rodnunsky | |
| 2005/0112963 | A1 | | 5/2005 | Lavorata | |
| 2005/0224438 | A1 | | 10/2005 | Maurer | |
| 2007/0064208 | A1 | | 3/2007 | Giegerich | |
| 2007/0114505 | A1 | | 5/2007 | Reyes | |
| 2008/0121601 | A1 | | 5/2008 | Ehrenleitner | |
| 2009/0066100 | A1 | | 3/2009 | Bosscher | |
| 2009/0159548 | A1 | | 6/2009 | Waisanen | |
| 2013/0126457 | A1 | | 5/2013 | Sturm | |

FOREIGN PATENT DOCUMENTS

| | | | |
|---|---|---|---|
| DE | 3639651 | A1 | 6/1988 |
| DE | 10245868 | A1 | 4/2004 |
| DE | 102005030969 | A1 | 12/2006 |
| EP | 1524187 | | 4/2005 |
| FR | 2085267 | A1 | 12/1971 |
| GB | 725457 | | 3/1955 |
| GB | 2012238 | | 7/1979 |
| GB | 2278821 | | 12/1994 |
| JP | 47030457 | U | 12/1972 |
| JP | 64013395 | A | 1/1989 |
| JP | 03100279 | U | 10/1991 |
| JP | 05019280 | U | 3/1993 |
| JP | H0733384 | A | 2/1995 |
| JP | H0761766 | A | 3/1995 |
| JP | 2004075233 | A | 3/2004 |
| JP | 2004155580 | A | 6/2004 |
| NL | 7203224 | A | 10/1972 |
| SU | 1157007 | A1 | 5/1985 |
| WO | 8909723 | | 10/1989 |
| WO | 2005013195 | A2 | 2/2005 |
| WO | 2007139383 | A1 | 12/2006 |
| WO | 2011123816 | A2 | 10/2011 |

OTHER PUBLICATIONS

Office Action for U.S. Appl. No. 13/078,801, dated Apr. 23, 2013.
Final Office Action for U.S. Appl. No. 13/078,801, dated Jan. 2, 2014.
Office Action for U.S. Appl. No. 13/078,801, dated Aug. 12, 2014.
Final Office Action for U.S. Appl. No. 13/078,801, dated Mar. 12, 2015.
Office Action for U.S. Appl. No. 13/078,801, dated Jun. 3, 2016.
Response to Office Action for U.S. Appl. No. 13/078,801, filed Apr. 14, 2016.
Response to Office Action for U.S. Appl. No. 13/078,801, filed Dec. 12, 2014.
Response to Office Action for U.S. Appl. No. 13/078,801, filed Jul. 2, 2014.
Response to Office Action for U.S. Appl. No. 13/078,801, filed Oct. 23, 2013.
Japanese Office Action dated Dec. 17, 2014, for Japanese patent application No. 2013-502901, filed Jun. 29, 2011.
Russian Office Action dated Feb. 24, 2015, for Russian patent application No. 2012146516, filed Apr. 1, 2011.
Ukrainian Office Action dated Jul. 7, 2014 for Ukrainian patent application No. 201212292, filed Apr. 1, 2011.
Office Action dated Apr. 23, 2013 for U.S. Appl. No. 13/078,801.

(56) References Cited

OTHER PUBLICATIONS

Office Action dated Jan. 2, 2014 for U.S. Appl. No. 13/078,801.
Office Action dated Mar. 12, 2015 for U.S. Appl. No. 13/078,801.
Response filed Oct. 23, 2013 for U.S. Appl. No. 13/078,801.
Office Action dated Aug. 12, 2014 for U.S. Appl. No. 13/078,801.
Response filed Dec. 12, 2014 for U.S. Appl. No. 13/073,801.
Copy of response filed Apr. 14, 2016 for U.S. Appl. No. 13/078,801.
Office Action dated Jun. 3, 2016 for U.S. Appl. No. 13/078,801.
Response filed Jul. 5, 2017 for U.S. Appl. No. 13/078,801.
Response filed Sep. 20, 2017 for U.S. Appl. No. 13/078,801.
Supplemental Amendment filed Sep. 29, 2017 for U.S. Appl. No. 13/078,801.

* cited by examiner

BOAT DEPLOYMENT ASSEMBLY AND METHOD

CROSS REFERENCE TO RELATED APPLICATION

This application refers to and claims priority on U.S. Provisional Application Ser. No. 61/703,964 filed Sep. 21, 2012, the content of which is hereby incorporated by reference in its entirety.

BACKGROUND

The discussion below is merely provided for general background information and is not intended to be used as an aid in determining the scope of the claimed subject matter.

Undesired motion of an object being hoisted is quite common. Deployment and retrieval of boats from structures or vessels is one example. The hoisting of the boat can sometimes be quite difficult due to for example and without limitation motion of the vessel, turbulence of the water and/or wind loads on the boat to be deployed or retrieved.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

Aspects of the present invention relate to hoists, where one embodiment of the invention is particularly advantageous for the deployment of boats or other items from a larger vessel at sea.

A first aspect of the present invention is a hoist system for lifting and lowering an object such as a boat, which includes a support structure, a support member supported by the support structure and a hoisting assembly. The hoisting assembly includes an attachment assembly and a set of at least three flexible members operably coupled to the support member and the attachment assembly to retract and extend the attachment assembly vertically relative to a reference axis. The hoisting assembly is supported by the support structure and configured with the support member so as to space apart the flexible members from each other, and wherein each flexible member defines an oblique angle with the reference axis parallel to the vertical reference axis.

In a further embodiment, the hoisting assembly includes a second support member supported by the support structure, a second attachment assembly and a second set of at least three flexible members operably coupled to the second support member and the second attachment assembly to retract and extend the second attachment assembly vertically relative to a second reference axis. In this embodiment, the hoisting assembly is configured with the second support member so as to space apart the flexible members of the second set from each other, wherein each flexible member of the second set defines an oblique angle with the second reference axis parallel to a vertical reference axis. The second set of flexible members is operably coupled to the second support member such that the second reference axis is spaced apart from the reference axis of the other set of flexible members.

Another aspect of the present invention is a method of lifting and lowering an object comprising: extending a set of at least three flexible members operably coupled to a support member, an attachment assembly and a hoist assembly to retract and extend the attachment assembly vertically relative to a reference axis, the hoisting assembly being supported by a support structure and configured with the support member so as to space apart the flexible members from each other, and wherein each flexible member defines an oblique angle with the reference axis parallel to a vertical reference axis; coupling the object to the attachment assembly; and deploying or retracting the flexible members by operation of the hoist assembly to lower or lift the object.

In a further embodiment, the method can further include extending a second set of at least three flexible members and operably coupled to a second support member, a second attachment assembly and the hoist assembly to retract and extend the second attachment assembly vertically relative to a second reference axis spaced apart from the attachment assembly, the hoisting assembly being configured with the second support member so as to space apart the flexible members of the second set from each other, and wherein each flexible member of the second set defines an oblique angle with the second reference axis parallel to a vertical reference axis; coupling the object to the second attachment assembly at a point spaced apart from the attachment assembly; and deploying or retracting the flexible members by operation of the hoist assembly to lower or lift the object.

In any of the systems or methods described above the following features can be included alone or in combination. For instance, the hoist assembly can comprise two hoist assemblies, each hoisting assembly controlling extension and retraction of one of the sets of at least three flexible members. If desired, the hoist assembly includes a hoist, or at least a drum, for each flexible member. In a preferred embodiment, the support members, which could also comprise a single support member for both sets of flexible members, is supported in a cantilevered manner from the support structure.

The attachment assemblies can comprise a connector that is detachable from the object. The connector can provide one or more degrees of pivotal freedom such as embodied as a universal joint or a spherical joint.

The hoist system commonly comprise a controller operably coupled to the hoist assembly to control deployment and retraction of the flexible members. In one embodiment, the controller stores data indicative of the attachment assemblies being at a different selected vertical distances away from corresponding support members, the controller configured to lower and raise each of the attachment assemblies and maintain the selected vertical distance. Using an interface, the controller can be used to train the hoist system by adjusting the height of the attachment assemblies individually for one or more objects the hoist system will be used for. The preselected positions and/or selected vertical distances between the attachment assemblies can be stored individually and accessed to control the hoist system automatically to adjust the positions of the attachment assemblies when commanded by a user interface. Similarly, it should be understood that the controller can have stored positions of the support member(s) relative to each other and/or relative to the support structure for one or more objects to be lifted. Again, the hoist system can be operated to obtain these positions during training, whereafter the positions and/or relative distances can be stored.

Aspects of the invention are particularly advantageous when the support structure comprises a vessel and the attachment assemblies are configured to connect to a boat at spaced apart locations on the boat.

DETAILED DESCRIPTION OF THE ILLUSTRATIVE EMBODIMENT

Figure 1:
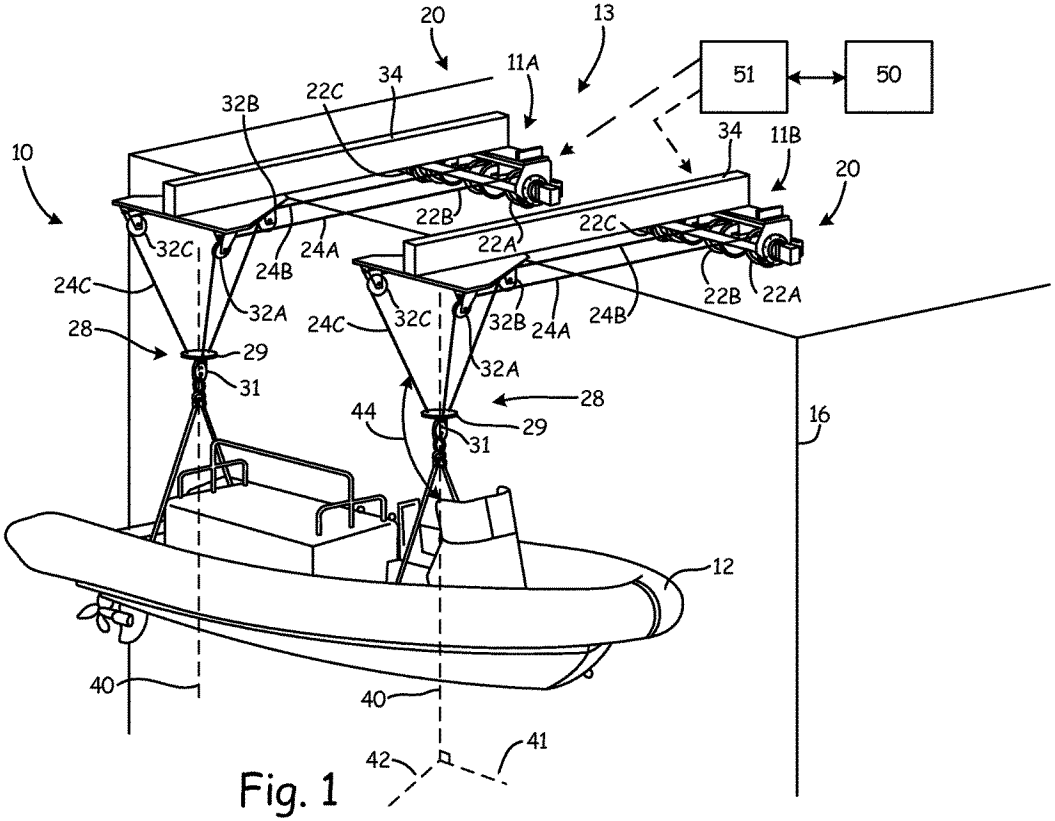
FIG. 1 in a perspective view of a hoist system in a first position.
Figure 2:
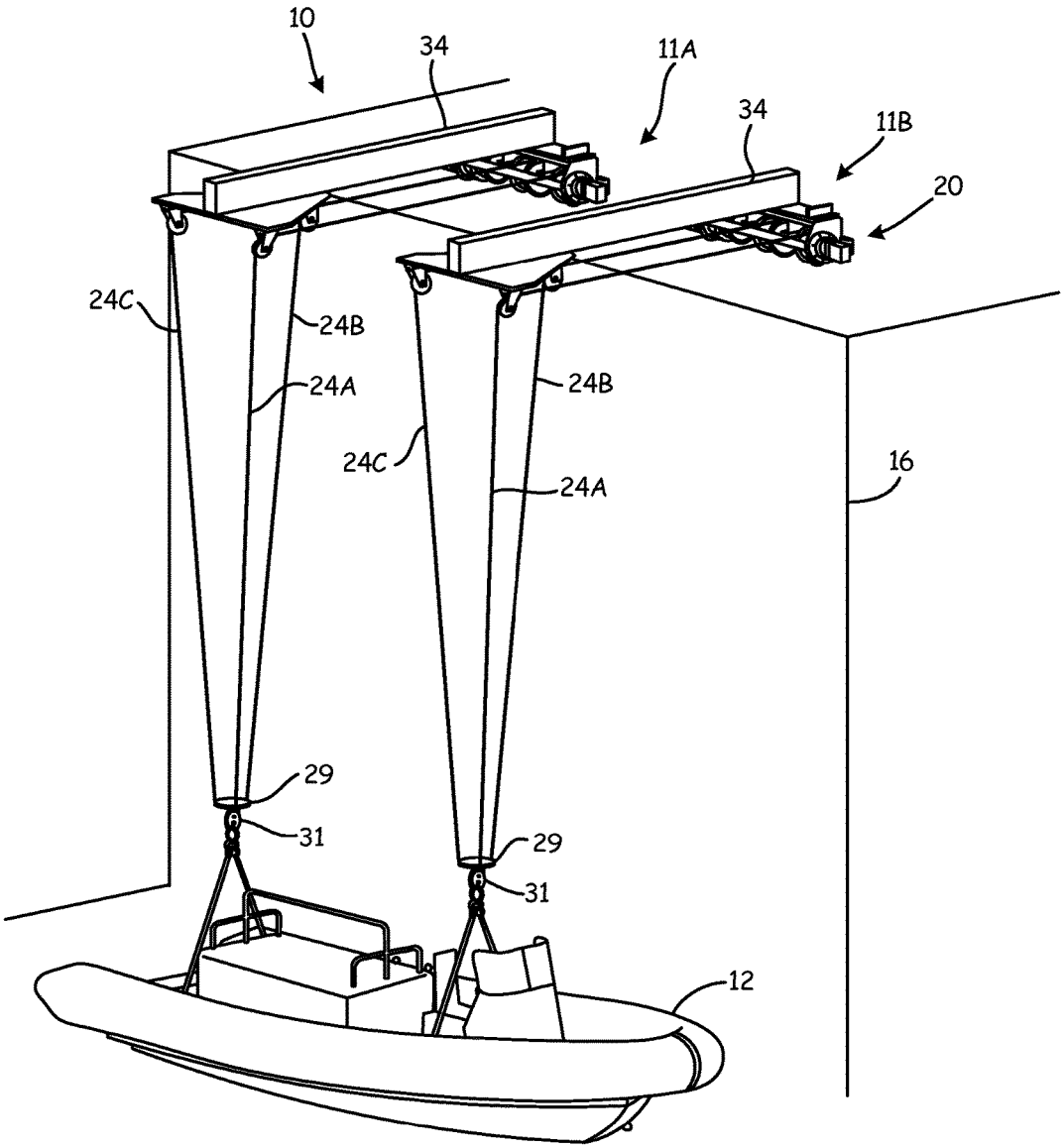
FIG. 2 in a perspective view of a hoist system in a second position.

A hoist system is generally illustrated at 10 in the figures. The hoist system 10 includes a hoisting assembly 13, herein exemplified as including one or more hoist assemblies 11A and 11B, used to hoist an object 12 using one, and in a preferred embodiment, at least two spaced apart attachment points on the object 12, each attachment point having a plurality of elongated flexible members, preferably three elongated flexible members for supporting the attachment point. The hoist system 10 is advantageous in that the hoist system 10 can provide a measure of restraint for movement of the object 12 in up to six degrees of freedom.

Herein, the hoist system 10 is exemplified for hoisting a small boat 12 such as from a larger vessel 16, illustrated schematically. In this embodiment, the small boat 12 is less likely to move during hoisting (i.e. suspended), be it deployment or recovery, where the movement of the small boat 12 is caused by but not limited to movement of the vessel 16. It should be understood that aspects of the present invention are not limited to the embodiment shown in that the hoist system 10 can be used to hoist other objects such as but not limited to submersibles, unmanned vessels, and the like. Likewise, aspects of the invention are not limited to use on a vessel 16 or even at sea, but rather, can be used in any other application where restraint of movement of the object hoisted is desired. For instance, other applications are situations where the object, the hoist and/or the support structure 16 experiences wind loading, which can take place even on stationary support structures or support structures that move such as vessel 16 exemplified herein.

In the embodiment illustrated, the hoist system 10 includes two identical hoist assemblies 11A and 11B. Each of the hoist assemblies 11A and 11B are mounted to the vessel 16 or a support structure connected thereto. Each hoist assembly 11A, 11B includes a hoist or a plurality of hoists 20 (herein by way of example three hoists 22A, 22B and 22C) to control a plurality of elongated flexible members, herein exemplified as wire ropes 24A, 24B and 24C. The wire ropes 24A, 24B and 24C extend from the drum(s) of the hoist(s) 20 and the remote ends are each connected to a load attachment assembly 28 used to engage (in this embodiment removably or detachably engage) the object 12 to be hoisted. In yet an alternative embodiment it should be noted, the hoist system 10 can include a single hoist with multiple drum(s) to control at least two sets of the plurality of elongated flexible members to provide two spaced apart lifting points for the object 12. Likewise, a single hoist having multiple drums can be provided for each hoist assembly 11A, 11*b*. Generally, the load attachment assembly 28 includes a plate 29, herein exemplified as a plate, to which the ropes 24A, 24B and 24C are connected and a connector 31 attached to and supported by the plate 29. The connector 31 can take many well-known forms such as but not limited to hooks, clasps, shackles and quick release mechanisms to name just a few. Except for the form of the connection between the connector 31 and the plate 29 as discussed below, the specific type of connector 31 is not pertinent to the present invention.

In the embodiment illustrated, each of the wire ropes 24A, 24B and 24C are guided and supported by a corresponding pulley or sheave, herein 32A, 32B and 32C, respectively. A support member 34 supports sheaves 32A, 32B and 32C. In this embodiment, the support member 34 extends outwardly, preferably in a cantilevered manner, from vessel 16 being fixedly coupled thereto at least at one end. The support member 34 can be mounted in a stationary position on structure 16 or be movable relative thereto. For instance, one or both of the support members 34 can extend and retract such as in a telescoping manner or be pivotable. If desired, one or both of the support members 34 can move linearly, for example on rails, in any or all of three orthogonal axes oriented relative to the structure 16. Depending on the type and/or extend of movement and/or the use of additional guiding sheaves if necessary for the flexible members 24A-24C, the drums associated therewith may or may not move with the corresponding support structure. If desired, a single, cantilevered support member can be used to both sets of wire ropes in a spaced apart manner.

Each of the sets of wire ropes 24A-24C is configured so as to provide support and moreover restraint to the corresponding plate 29 in multiple degrees of freedom. In the embodiment illustrated, the sheaves 32A, 32B and 32C are configured on the support member 34 to which they are connected so that the wire ropes 24A-24C extend downwardly about a vertical reference axis, herein extending through the plate 29, where each rope defines an oblique angle 44 with the reference axis 40, stated another way, an obtuse angle with the reference axis 40 below the attachment assembly 28 In an alternative embodiment, the hoist(s) 20 may be disposed above the object 12 to be hoisted without the use of sheaves so as to provide two sets of flexible members to provide two spaced apart attachment points for the object 12. Typically, each of the sets of wire ropes 24A-24C comprise three or more spaced apart individual ropes about the reference axis 40 so as to provide restraint of the plate 29 in six degrees of freedom; however, this is but one embodiment. In further embodiments, the number of ropes can comprise more than three and also the number of ropes used for each of the attachment assemblies 28 can be different. Likewise, it should be understood that the wire ropes may not be disposed at equal angular intervals about the reference axis 40.

The connection of each of the connectors 31 to the corresponding plate 29 can be in a fixed manner or with a pivotal connection. The pivotal connection can allow rotation only about the reference axis 40, or in a further embodiment, the connector 31 is joined to the plate 29 using a spherical type joint or its equivalent that allows pivotal movement about the axis 40 as well as pivotal movement about one or more axes perpendicular to axis 40 (indicated as axes 41 and 42), if desired. Such joints are well-known and can include by way of example a spherical joint or a universal joint, which provides two degrees of pivotal freedom, or in combination with a further pivot connection so as to provide the third degree of pivotal freedom. Use of a joint with such freedom of movement may be needed if it is desired that each of the ropes 24A-24C connected to each plate 29 shares the load of the object 12 at that attachment point substantially equally (if the ropes 24A-24C are disposed at equal angular intervals about the axis 40).

In a mode of operation, to lift or lower the object 12, the hoist system 10 is typically configured and commanded so as to retract or extend all of the ropes in unison so that the spaced apart attachment points (e.g. represented by plates 29) move in unison and the object 12 does not change in orientation during hoisting. In the embodiment illustrated, each of the hoist assemblies 11A and 11B are operated in unison from a single command to lift or lower the object 12 from an operator interface panel indicated at 50 that provides an input signal to a controller 51, that in turn instructs the hoist assemblies 11A and 11B to play out or retract the same amount of wire of each of the ropes for each attachment point. Nevertheless, if desired and if configured as such, the hoist assemblies 11A and 11B can be operated independent of each other if, for example, pitching of the object 12 is desired. Likewise, although typically each of the hoists 20 of each of the hoist assemblies 11A and 11B is operated in the same manner to play out or retract the same amount of rope for each attachment point so that the corresponding plate 29 maintains a fixed orientation, preferably orthogonal, to the reference axis 40 during lifting or lowering, if desired, each of the hoists 20 of each hoist assembly 11A, 11B can be operated independently from each other so as to change the position and/or orientation of the associated plate 29 relative to its corresponding reference axis 40 as desired.

In yet a further embodiment, one or more of the support members 34 can move on the support structure in unison or separately in any of the movements described above to change the position or orientation of the object 12 as desired.

Any number of load sensor(s) and/or displacement sensor(s) (linear or rotational) indicative of the object 12 and/or any part of the hoist system 10 can provide input(s) to controller 51 to control operation of the hoist system 10 and/or be rendered to the user via interface 50 as desired.

Individual operation of each of the hoists 20 of each of the hoist assemblies 11A, 11B may be preferred in order to train or calibrate the hoist system 10 to the object(s) 12 to be lifted. In particular, such calibration can include adjusting the position of each of the plates 29 for each of the hoist assemblies 11A, 11B relative to each other for the object 12, or each of the objects 12 that the hoist is used for. Stated another way the controller 51 is operably coupled to the hoist assembly or assemblies to control deployment and retraction of the flexible members 24A-24C, wherein the controller stores data indicative of the attachment assemblies being at a different selected vertical distances away from corresponding support members, by way of understanding. It should be noted the controller 51 can use other signals as the basis for the position of the attachment assembly 28 such as but not limited to the rotary position and number of revolutions of the hoists 22A-22C.

For instance, depending on the mechanisms used to connect each of the connectors 31 to the object 12, it may be necessary that one of the plates 29 of the hoist assemblies 11A, 11B is lower than the plate 29 of the other hoist assembly during hoisting. This relative position between the plates 29 can be stored in memory in controller 51, for instance through interface 50. Storing the relative position(s) allows the hoist 11A and 11B to fully retract the associated wire ropes 24A-24C as desired such as equally. Then, when the hoist system 10 will be used to hoist an object 12, the type of object 12 can be indicated (if needed) and the stored relative positions and/or relative distances can be retrieved from memory, where the hoist system 10, in one embodiment based on a single command from the user using the interface 50, automatically commands the hoists 11A and 11B (and movements of the support members 34 as described above) so as to obtain the desired relative position or in effect a vertical distance between the plates 29 (for example as reference with respect to each corresponding support member 34 for purposes of understanding but not necessarily as a basis for control), and/or orientation of the plates 29 commonly with feedback provided from suitable sensors based on one or a few commands from the user using the interface 50 based on information indicative of a stored preselected vertical distance difference between the attachment assemblies. Similarly, it should be understood that the controller 50 can have stored positions of the support member(s) 34 relative to each other and/or relative to the support structure for one or more objects to be lifted. Again, the hoist system can be operated to obtain these positions during training, whereafter the positions and/or relative distances can be stored.

Once the desired relative position and/or orientation of the plates 29 or attachment assemblies 28 has been obtained the controller 51 controlling the hoist assemblies 11A, 11B can be commanded to maintain the relative position and orientation during lifting or lowering of the object 12. If desired, individual control of the hoist assemblies 11A, 11B of the hoists 22A-22C during hoisting can also be provided.

The hoist system 10 is particularly well suited to maintain the desired orientation of a boat 12 so that movement of the boat 12 during lifting or lowering is minimized for longitudinal movements (parallel to a reference line extending between plates 29, if maintained at the same vertical height, and parallel to axis 41) as well as for lateral movements (parallel to axis 42). Rotational movements of the boat 12, in particular, roll (about a line parallel to axis 41), pitch (about a line parallel to axis 42) and yaw (about a line parallel to axis 40, which in the embodiment illustrated comprises a vertical axis extending from the surface of the water) are also restrained.

In yet a further embodiment it should be noted that the hoist system 10 can comprise only a single point of attachment. In particular, the hoist system 10 can comprise one of the hoist assemblies (e.g. 11A) in the various forms as described above that controls three spaced apart wire ropes 24A-24C with the corresponding plate 29 attached at thereto.

Figure 3:
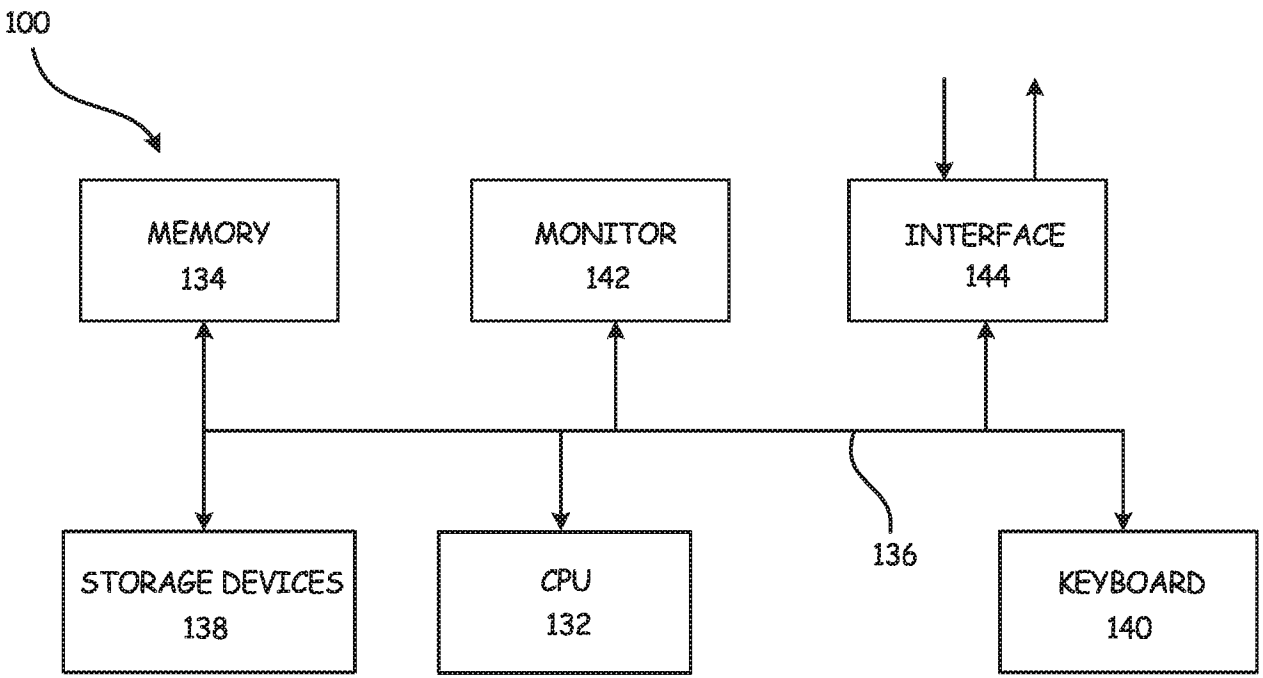
Fig. 3 (PRIOR ART)
FIG. 3 is a schematic illustration of a computer.

FIG. 3 and the related discussion provide a brief, general description of a suitable computing environment for the controller 51 and/or interface 50. Although not required, the controller can comprise computer-executable instructions, such as program modules, being executed by a computer 100. Generally, program modules include routine programs, objects, components, data structures, etc., which perform particular tasks or implement particular abstract data types. Those skilled in the art can implement the description herein provided to computer-executable instructions. Moreover, those skilled in the art will appreciate that the invention may be practiced with other computer system configurations, including multi-processor systems, mini computers, computer on a chip, and the like. The invention may also be practiced in distributed computing environments where tasks are performed by remote processing devices that are linked through a communications network. In a distributed computer environment, program modules may be located in both local and remote memory storage devices.

The computer 100 illustrated in FIG. 4 comprises a conventional computer having a central processing unit (CPU) 132, memory 134 and a system bus 136, which couples various system components, including the memory 134 to the CPU 132. The system bus 136 may be any of several types of bus structures including a memory bus or a memory controller, a peripheral bus, and a local bus using any of a variety of bus architectures. The memory 134 includes read only memory (ROM) and random access memory (RAM). A basic input/output (BIOS) containing the basic routine that helps to transfer information between elements within the computer 100, such as during start-up, is stored in ROM. Non-transitory computer readable storage devices 138, such as a hard disk, an optical disk drive, ROM, RAM, flash memory cards, etc., are coupled to the system bus 136 and are used for storage of programs and data. Commonly, programs are loaded into memory 134 from at least one of the storage devices 138 with or without accompanying data.

An input device 140 typically included on interface 50 such as a keyboard, joystick(s), or the like, that allows the user to provide commands to the computer 100. A display 142 or other type of output device can be connected to the system bus 136 via a suitable interface and provides feedback to the user. The command signals for the hoist assembly or assemblies can be provided, in part, based on program modules executed by the computer 100 and through a suitable interface 144 coupling the computer 100 to the test system rigs. The interface 144 can also receive feedback signals from load and/or displacement sensors embodied in the hoist system 10 as desired.

Although the subject matter has been described in language specific to structural features and/or methodological acts, it is to be understood that the subject matter defined in the appended claims is not necessarily limited to the specific features or acts described above as has been held by the courts. Rather, the specific features and acts described above are disclosed as example forms of implementing the claims.

What is claimed is:

1. A hoist system comprising:

a support structure;

a first support member supported by the support structure;

a first hoisting assembly comprising:

a first attachment assembly; and a first set of at least three flexible members operably coupled to the first support member and the first attachment assembly to retract and extend the first attachment assembly vertically along a first reference axis, the first hoisting assembly being supported by the support structure and configured with the first support member so as to space apart the flexible members of the first set from each other at equal angular intervals in a complete first circle about the first reference axis, the first circle being in a first plane orthogonal to the first reference axis, wherein the first set of at least three flexible members extend from the first support member toward the first attachment assembly in a converging manner, and wherein each flexible member of the first set has a similar oblique angle with the first reference axis parallel to a vertical reference axis;

a second support member supported by the support structure;

a second attachment assembly; and a second hoisting assembly comprising:

a second set of at least three flexible members spaced apart from the first set of at least three flexible members and operably coupled to the second support member and the second attachment assembly to assemblies comprise a connector providing three degrees of pivotal freedom.

2. The hoist system of claim 1 wherein each hoisting assembly includes a hoist for each flexible member.

3. The hoist system of claim 1 wherein each of the attachment assemblies comprise a connector providing only one degree of pivotal freedom.

4. The hoist system of claim 1 wherein each of the attachment assemblies comprise a connector providing only two degrees of pivotal freedom.

5. The hoist system of claim 1 wherein each of the attachment oblique angle with the first reference axis which is parallel to a vertical reference axis, and the second set of at least three flexible members being operably coupled to a second support member and a second attachment assembly to retract and extend the second attachment assembly vertically along a second reference axis spaced apart from the first attachment assembly, the second hoisting assembly being configured with the second support member so as to space apart the flexible members of the second set from each other at equal angular intervals in a complete second circle about the second reference axis, the second circle being in a second plane orthogonal to the second reference axis, wherein the second set of at least three flexible members extend from the second support member toward the second attachment assembly in a converging manner, and wherein each flexible member of the second set defines a similar oblique angle with the second reference axis which is parallel to the vertical reference axis;

coupling the object to the first attachment assembly and the second attachment assembly at spaced apart locations on the object; and deploying or retracting the flexible members of each hoisting assembly by operation of the first hoisting assembly and the second hoisting assembly to lower or lift the object.

6. The hoist system of claim 1 and further comprising a controller operably coupled to the hoisting assemblies to control deployment and retraction of the flexible members, wherein the controller stores data indicative of the attachment assemblies being at a different selected vertical distances away from corresponding support members, the controller configured to lower and raise each of the attachment assemblies and maintain a desired selected vertical distance.

7. The hoist system of claim 1 wherein the support structure comprises a vessel and the attachment assemblies are configured to connect to a boat at spaced apart locations on the boat.

8. A method of lifting and lowering an object comprising:

providing a first set of at least three flexible members of a first hoisting assembly and a second set of at least three flexible members of a second hoisting assembly, the first set of at least three flexible members being operably coupled to a first support member and a first attachment assembly to retract and extend the first attachment assembly vertically along a first reference axis, the first hoisting assembly being configured with the first support member so as to space apart the flexible members of the first set from each other at equal angular intervals in a complete first circle about the first reference axis, the first circle being in a first plane orthogonal to the first reference axis, wherein the first set of at least three flexible members extend from the first support member toward the first attachment assembly in a converging manner, and wherein each flexible member of the first set defines a similar retract and extend the second attachment assembly vertically along a second reference axis, the second hoisting assembly being supported by the support structure and configured with the second support member so as to space apart the flexible members of the second set from each other at equal angular intervals in a complete second circle about the second reference axis, the second circle being in a second plane orthogonal to the second reference axis, wherein the second set of at least three flexible members extend from the second support member toward the second attachment assembly in a converging manner, and wherein each flexible member of the second set has a similar oblique angle with the second reference axis parallel to the vertical reference axis, the second set of flexible members operably coupled to the second support member such that the second reference axis is spaced apart from the first reference axis of the first set of at least three flexible members.

9. The method of claim 8 wherein deploying or retracting the flexible members comprises deploying or retracting the flexible members of the first and second sets so as to move the attachment assemblies in unison.

10. The method of claim 8 wherein deploying or retracting the flexible members comprises deploying or retracting the flexible members of the first and second sets differently so as to change an orientation of the object.

11. The method of claim 8 and further comprising:

prior to coupling the object to the first and second attachment assemblies, adjusting a position of each of the attachment assemblies to a different vertical position relative to each corresponding support member so as to have a vertical distance difference between the first and second attachment assemblies.

12. The method of claim 11 and further comprising:

storing information indicative of the vertical distance difference between the first and second attachment assemblies.

13. The method of claim 11 wherein adjusting comprises operating at least one of the first hoisting assembly and second hoisting assembly to adjust one or more positions of the attachment assemblies to obtain the vertical distance difference between the first and second attachment assemblies based on stored information indicative of the vertical distance difference between the first and second attachment assemblies.

* * * * *